US006445347B1

(12) United States Patent
Yoshimi

(10) Patent No.: US 6,445,347 B1
(45) Date of Patent: Sep. 3, 2002

(54) PORTABLE RADIO DEVICES AND MANUFACTURING METHOD OF PORTABLE RADIO DEVICES BODY

(75) Inventor: Akitoshi Yoshimi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/386,224

(22) Filed: Aug. 31, 1999

(30) Foreign Application Priority Data

Apr. 6, 1999 (JP) ..... PCT/JP99/1819

(51) Int. Cl.[7] ..... H01Q 1/24; H01Q 1/36
(52) U.S. Cl. ..... 343/702; 343/895
(58) Field of Search ..... 343/702, 895, 343/900, 901, 893, 751; H01Q 1/24, 1/36

(56) References Cited

U.S. PATENT DOCUMENTS 5,101,213 A * 3/1992 Harada et al. ..... 343/715
5,343,213 A * 8/1994 Kottle et al. ..... 343/702
5,710,567 A * 1/1998 Funke ..... 343/702
5,982,330 A * 11/1999 Koyanagi et al. ..... 343/702
6,031,493 A * 2/2000 Tsuda et al. ..... 343/702
6,031,496 A * 2/2000 Kuittinen et al. ..... 343/702
6,069,592 A * 5/2000 Wass ..... 343/895
6,094,178 A * 7/2000 Sanford ..... 343/895
6,154,184 A * 11/2000 Endo et al. ..... 343/895
6,181,286 B1 * 1/2001 Roscoe et al. ..... 343/725
6,212,400 B1 * 4/2001 Scholz ..... 455/550
6,222,505 B1 * 4/2001 Endo et al. ..... 343/895

FOREIGN PATENT DOCUMENTS

JP 1056315 2/1998
JP 1146108 2/1999

* cited by examiner

*Primary Examiner*—Don Wong
*Assistant Examiner*—Trinh Vo Dinh
(74) *Attorney, Agent, or Firm*—Rothwell, Figg, Ernst & Manbeck

(57) ABSTRACT

Of two body parts constituting a cellular telephone, a back body part has a body main part and an antenna attachment portion. An antenna for transmitting and receiving radio waves to and from a satellite has a cylindrical excitation antenna and a cylindrical helical antenna. The helical antenna is attached in such a manner that it can be pulled out to establish a state that it does not contact the inner circumferential surface of the excitation antenna. The excitation antenna is integrally molded with the back body part such that of the outer circumferential surface of the excitation antenna an antenna element surface that is formed with antenna elements comes into close contact with the inner circumferential surface of the antenna attachment portion. This structure dispenses with, for example, work of attaching an attaching member to the body, thus simplifying the manufacturing process.

13 Claims, 6 Drawing Sheets

PORTABLE RADIO DEVICES AND MANUFACTURING METHOD OF PORTABLE RADIO DEVICES BODY

BACKGROUND OF THE INVENTION

1. Field of the Invention:

The present invention relates to portable radio devices such as cellular telephones and a manufacturing method of a body that is applied to portable radio devices.

2. Background Art:

Among related art antennas that are used in portable radio devices as typified by cellular telephones are antennas that are provided such that they can be pulled out from the top portion of a body. Since antennas of this kind are accommodated in a body in an unused state and can be pulled out of the body when used, it can be said that their structures are superior in portability and provide superior antenna characteristics.

FIG. 7 shows an attachment structure of an antenna that is provided in a related art cellular telephone. An antenna 100 is attached to an antenna holder 101. The antenna holder 101 can be screwed into a nut 103 that is fixed to a body 102. The antenna 100 is attached to the body 102 in such a manner that the antenna holder 101 is screwed into the nut 103 in a state that the antenna 100 is attached to the antenna holder 101.

Incidentally, antennas used in cellular telephones are usually required to have a superior circular polarization characteristic. To satisfy this requirement, the present assignee has proposed an antenna which can provide a superior circular polarization characteristic. Specifically, this antenna has a first cylindrical antenna that is fixed to the top portion of the body of a cellular telephone and a second cylindrical antenna that can be pulled out so as to be placed in the internal space of the first antenna in a non-contact state. A plurality of dipole array antenna elements are formed on the circumferential surface of the first antenna. A plurality of helical antenna elements are formed on the circumferential surface of the second antenna. When pulled out of the first antenna, the second antenna is erected so as to come close to the top portion of the first antenna. In this state, the antenna elements of the first antenna and those of the second antenna are brought into capacitive coupling, whereby a superior circular polarization characteristic can be obtained.

As for the antenna having the above structure, in fixing the first antenna to the body, it is conceivable to attach the first antenna to an antenna holder and then screwing the antenna holder into a nut in the same manner as described above. However, in this case, it is necessary to bury the nut in the top portion of the body and then screw the antenna holder that is fitted with the first antenna into the nut. Therefore, there is fear of a problem that in manufacturing a body with an antenna the manufacturing work is very cumbersome and the manufacture takes a long time.

SUMMARY OF THE INVENTION

In view of the above, an object of the present invention is to provide a portable radio device which has a movable second antenna that is so provided that it can be pulled out so as not to contact the inner circumferential surface of a fixed first antenna, and which can simplify a manufacturing process.

Another object of the invention is to provide a manufacturing method of a body which can simplify a manufacturing process of a portable radio device body in which an antenna formed with antenna elements is attached to the inner circumferential surface of an antenna attachment portion that projects outward from a body main part.

To attain the above objects, the invention provides a portable radio device comprising a body incorporating a transmission/reception circuit for radio communication and having a cylindrical antenna attachment portion that projects outward; and an antenna device having a first antenna that is attached to the antenna attachment portion and a second antenna that is provided movably and is to be electrically coupled with the first antenna, wherein the first antenna has first antenna elements that are formed on a circumferential surface and electrically connected to the transmission/reception circuit, and is integrally molded with the antenna attachment portion such that the first antenna elements come into close contact with an inner circumferential surface of the antenna attachment portion.

In the invention, the first antenna is attached to the body in such a manner that the first antenna is integrally molded with the antenna attachment portion. Therefore, unlike the related art case, manufacture of this portable radio device does not require work of burying a nut in the body and screwing an antenna holder into the nut. Therefore, the manufacturing process of this portable radio device can be simplified and hence its manufacturing efficiency can be increased.

Since the antenna element surface of the first antenna is in close contact with the inner circumferential surface of the antenna attachment portion. Therefore, for example, even if the antenna element surface is formed on the outer circumferential surface of the first antenna, the antenna element surface can be protected properly. This advantage is particularly effective in case where the first antenna elements are formed by plating a thin conductive metal that is prone to be damaged.

No accompanied parts such as a nut for attaching the first antenna to the body are necessary at all. Therefore, no space other than the attachment space of the first antenna is necessary. This makes it possible to miniaturize portable radio devices as typified by cellular telephones. Therefore, the invention makes it possible to provide portable radio devices that are superior in portability and have improved user interfaces.

Further, since the first antenna is integrally molded with the body main part and the antenna attachment portion, the relative positional error between the first antenna and a circuit board can be made within a prescribed range. Therefore, the first antenna elements and the transmission/reception circuit can be connected to each other at correct positions.

According to another aspect of the invention, there is provided a manufacturing method of a portable radio device body that has a cylindrical antenna attachment portion projecting outward from a body main part and in which a cylindrical antenna formed with antenna elements is attached to an inner circumferential surface of the antenna attachment portion, comprising the steps of positioning the antenna in a die that is formed with a main part cavity having a shape corresponding to the body main part and an antenna cavity having a shape corresponding to the antenna attachment portion such that the antenna elements are faced at an inner circumferential surface of the antenna cavity; and forming the body main part and the antenna attachment portion and simultaneously integrally molding them each other such that the antenna elements of the antenna come into close contact with the inner circumferential surface of the antenna attachment portion by injecting a resin into the main part cavity and the antenna cavity.

In the invention, in producing the portable radio device body to which the antenna is to be attached, the body is molded with a resin and, at the same time, the antenna is integrally attached to the inner circumferential surface of the antenna attachment portion. Therefore, unlike the related art case, work of burying a nut in the body and screwing an antenna holder into the nut is not necessary. Therefore, the manufacturing process of this portable radio device body can be simplified and hence, its manufacturing efficiency can be increased. Further, since the body and the antenna can be produced at the same time, it is not necessary to manage the number of bodies and the number of antennas separately. This decreases the burden on operators.

DETAILED DESCRIPTION OF THE PREFERRED EMBODIMENTS

Embodiments of the present invention are hereinafter described in detail with reference to the accompanying drawings.

Embodiment 1

Figure 1A:
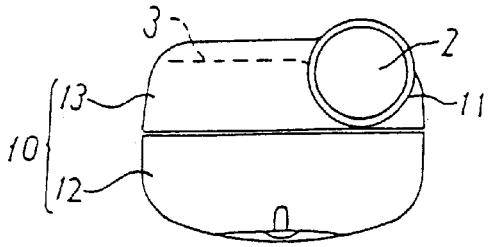
FIGS. 1A and 1B show an appearance of a cellular telephone according to a first embodiment of the present invention.
Figure 1B:
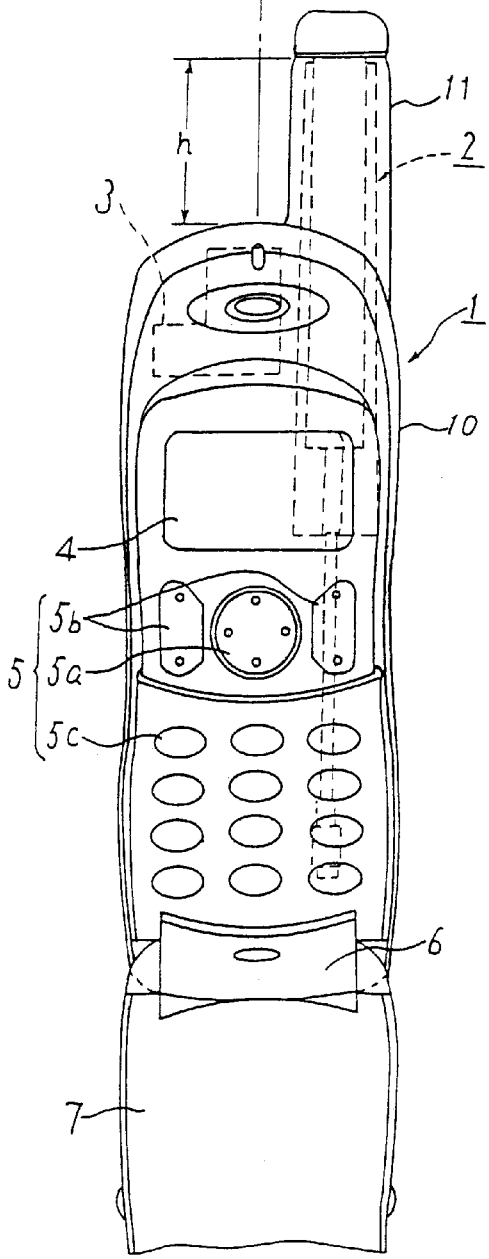

FIGS. 1A and 1B show an appearance of a cellular telephone according to a first embodiment of the invention. Specifically, FIGS. 1A and 1B are a plan view and a front view, respectively, of the cellular telephone. For example, this cellular telephone is a dual mode terminal that is applied to satellite cellular telephone systems and terrestrial cellular telephone systems. Examples of terrestrial cellular telephone systems are the PDC (personal digital cellular) system, the GSM (global system for mobile communications) system, and the CDMA (code division multiple access) system. This cellular telephone realizes mobile communication by exchanging radio waves with a communication satellite that is in an orbit tens of thousand kilometers above the earth or by exchanging radio waves with terrestrial base stations.

This cellular telephone has a body 1, a transmission/reception antenna 2 that is attached to the body 1 and serves for a satellite cellular telephone system, a transmission/reception antenna 3 that is incorporated in the top portion of the body 1 and serves for a terrestrial cellular telephone system, a display section 4 provided on the surface of the body 1, and a key manipulation section 5 also provided on the surface of the body 1. The key manipulation section 5 has a plurality of keys such as a function key 5*a*, scroll keys 5*b*, and ten keys 5*c*. A flip 7 is attached to the lower end portion of the body 1 via an attaching member 6. The flip 7 is opened in a used state as shown in FIG. 1 and closed in an unused state so as to cover the ten keys 5*c*.

The body 1 is made of an ABS (acrylonitrile-butadiene-styrene) resin or the like, and has a body main part 10 and a cylindrical antenna attachment portion 11. The body main part 10 consists of two body parts, that is, a front body part 12 and a back body part 13, and is shaped by combining these two body parts. The antenna attachment portion 11 projects straightly from the top end of the back body part 13 that is one of the two body parts. As described later, the height h of the antenna attachment portion 11 is set approximately equal to the length of an antenna element surface 30 as measured along the longitudinal direction of an excitation antenna 20. For example, the height h of the antenna attachment portion 11 is 30 mm. The antenna attachment portion 11 is provided on the right side when the cellular telephone is viewed from the front side. Further, the antenna attachment portion 11 somewhat bulges from the back surface of the body main part 10.

Figure 2:
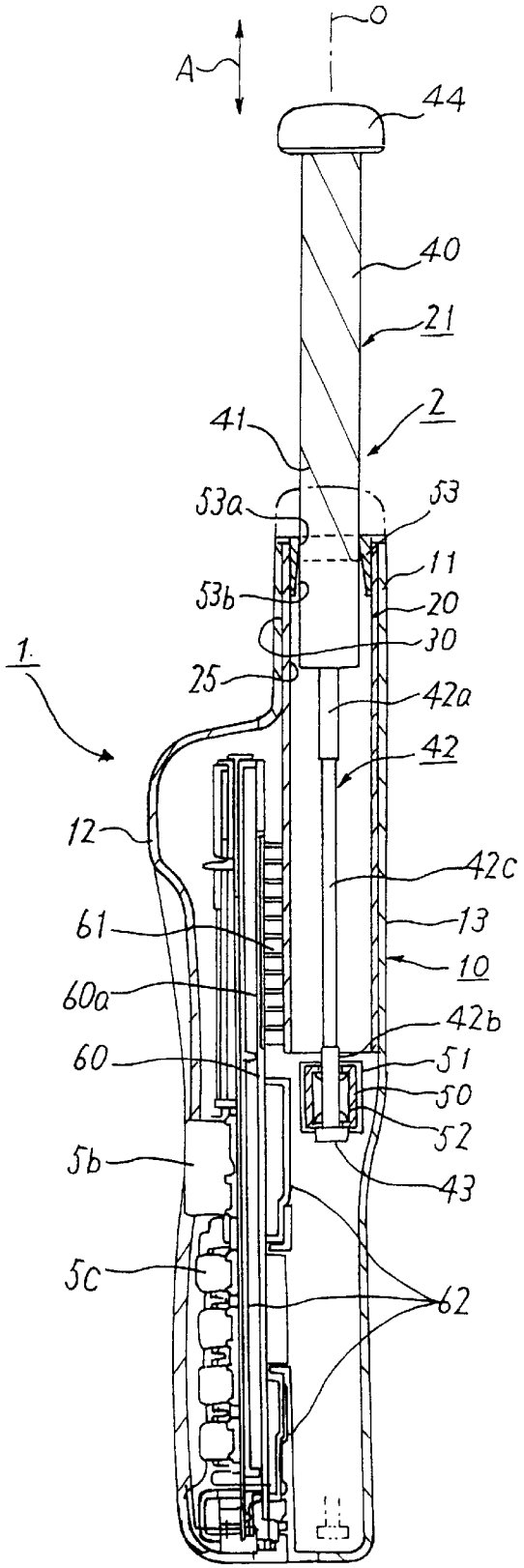
FIG. 2 is a sectional view showing the internal configuration of the cellular telephone.

FIG. 2 is a sectional view showing the internal configuration of the cellular telephone. The transmission/reception antenna 2 has the excitation antenna 20 corresponding to a first antenna and a helical antenna 21 corresponding to a second antenna. The excitation antenna 20 is an antenna fixed to the body 1. The helical antenna 21 is an antenna which is electrically coupled with the excitation antenna 20 and is movable with respect to the excitation antenna 20. The excitation antenna 20 and the helical antenna 21 are cylindrical and concentric with each other with respect to a single central axis O. The helical antenna 21 is movable with respect to the excitation antenna 20 in an axial direction A, that is, along the central axis O.

The excitation antenna 20 is integrally molded with the body 1. More specifically, the excitation antenna 20 is attached to the antenna attachment portion 11 integrally and attached to the back body part 13 integrally in such a manner that its lower portion extends to the middle portion of the back body part 13. In this case, the excitation antenna 20 is integrally molded with the body 1 such that the antenna element surface 30 comes into close contact with the inner circumferential surface 25 of the antenna attachment portion 11. In other words, the excitation antenna 20 is integrally molded with the body 1 such that no air layer is interposed between the excitation antenna 20 and the antenna attachment portion 11. This structure can not only simplify work of attaching the excitation antenna 20 to the body 1 but also increase the attachment strength of the excitation antenna 20.

Figure 3:
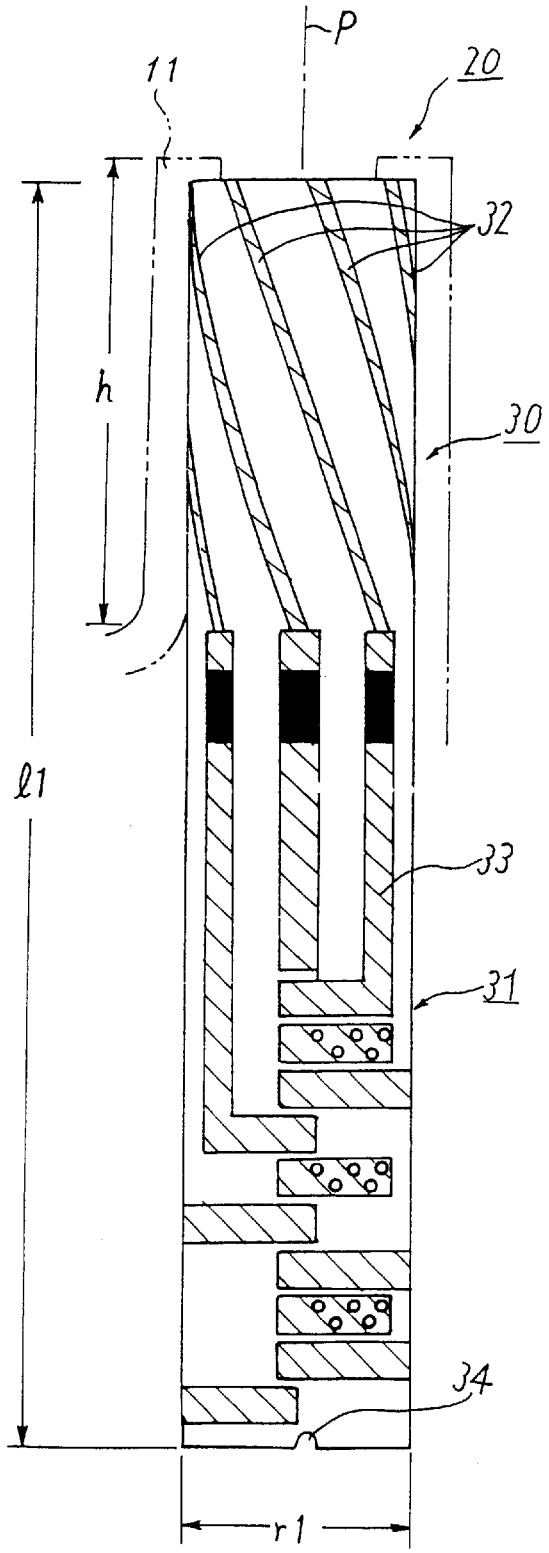
FIG. 3 is a front view showing the configuration of an excitation antenna.

FIG. 3 is a front view showing the configuration of the excitation antenna 20. For example, the excitation antenna 20 is made of an ABS resin having a low dielectric constant. The excitation antenna 20 has a cylindrical shape in which the diameter rl is 15 mm, for example, and the length 11 is 89 mm, for example. The excitation antenna 20 has the antenna element surface 30 and a feeding surface 31. The antenna element surface 30 is part of the outer circumferential surface of the excitation antenna 20. A plurality of (e.g., four) dipole array antenna elements 32 as first antenna elements are formed on the antenna element surface 30 in a prescribed pattern. The dipole array antenna elements 32 are formed at equal intervals so as to be inclined from the central axis P of the excitation antenna 20. The element length of the dipole array antenna elements 32 is set at about a half wavelength. For example, the dipole array antenna elements 32 are formed by plating a conductive metal at a thickness of several Am.

The feeding surface 31 corresponds to that part of the outer circumferential surface of the excitation antenna 20 which excludes the antenna element surface 30. A feeding circuit 33 of microstrip lines, etc. are formed on the feeding surface 31. The feeding circuit 33 supplies the dipole array antenna elements 32 with a signal that is given from a transmission/reception circuit 60*a* that is formed on a circuit board 60 (described later) and supplies the transmission/reception circuit 60*a* on the circuit board 60 with a signal that is given from the dipole array antenna elements 32.

The length of the antenna element surface 30 along the longitudinal direction of the excitation antenna 20 is determined based on ¼ of the wavelength of radio waves to be transmitted and received; for example, the length of the antenna element surface 30 is 30 mm. The height h of the antenna attachment portion 11 is set approximately equal to the length of the antenna element surface 30. That is, the antenna attachment portion 11 accommodates at least the entire antenna element surface 30 of the excitation antenna 20.

A U-shaped pin engagement recess 34 is formed in the lower end portion of the excitation antenna 20. The pin engagement recess 34 engages a fixing pin (not shown) to prevent deviation of the excitation antenna 20 during integrally molding the excitation antenna 20 with the back body part 13.

Figure 4:
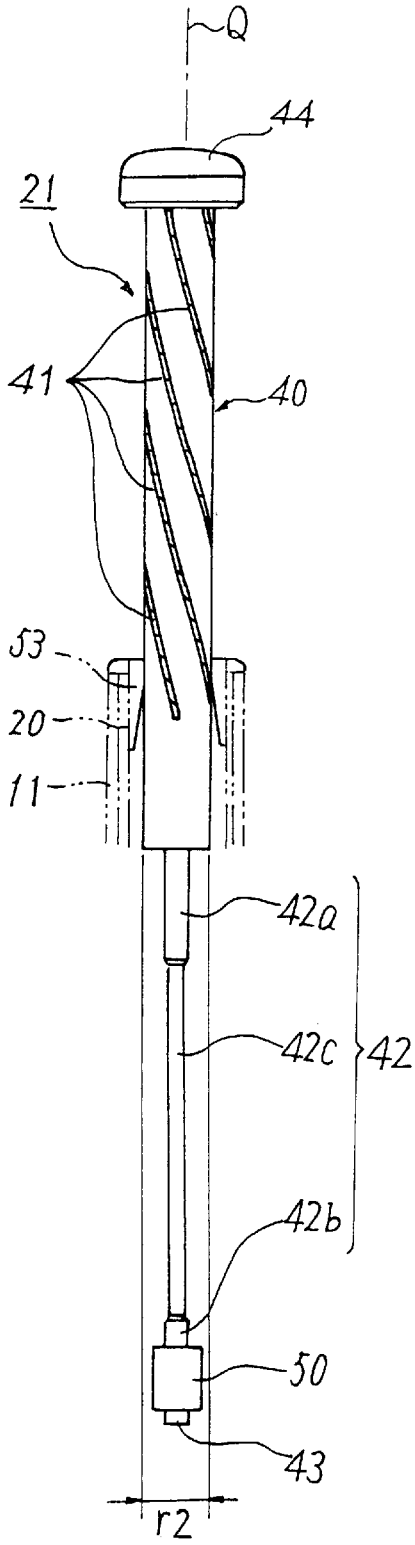
FIG. 4 is a front view showing the configuration of a helical antenna.

FIG. 4 is a front view showing the configuration of the helical antenna 21. The helical antenna 21 has a cylindrical shape whose diameter r2 (e.g., 9 mm) is smaller than the diameter r1 of the excitation antenna 20. The helical antenna 21 has an antenna element surface 40. The antenna element surface 40 occupies most of the circumferential surface of the helical antenna 21, that is, the portion extending from the top end to a prescribed position in the vicinity of the lower end of the helical antenna 21. To show numerical examples, when the length of the helical antenna 21 is 85 mm, the length of the antenna element surface 40 may be set at 69 mm.

A plurality of (e.g., four) helical antenna elements 41 as second antenna elements are formed on the antenna element surface 40 in a prescribed pattern. The plurality of helical antenna elements 41 are formed at equal intervals so as to be inclined from the central axis Q of the helical antenna 21. The element length of the helical antenna elements 41 is set at about a half wavelength. For example, the helical antenna elements 41 are formed by plating a conductive metal.

If the helical antenna elements 41 are exposed on the outer circumferential surface of the helical antenna 21, they are damaged unavoidably. Therefore, in the first embodiment, the helical antenna 21 is so configured that the antenna element surface 40 is coated with a protective resin or the like.

An antenna support pole 42 is attached to the lower end portion of the helical antenna 21 so as to extend in the longitudinal direction of the helical antenna 21. The antenna support pole 42 is to support the helical antenna 21. The antenna support pole 42 has an accommodation position determining large diameter portion 42*a* and an excitation position determining large diameter portion 42*b* at the respective ends. A small diameter portion 42*c* whose diameter is smaller than the large diameter portions 42*a* and 42*b* is the portion between the large diameter portions 42*a* and 42*b*. A tip member 43 whose diameter is larger than the excitation position determining large diameter portion 42*b* is attached to the tip of the antenna support pole 42. When the helical antenna 21 is lifted up, the tip member 43 touches a stopper 50 that is fixed to the back body part 13 via a holder 51 (described later), to thereby restrict the movement of the helical antenna 21 and prevent the helical antenna 21 from coming out of the body 1.

An elastic member 44 is attached to the upper end portion of the helical antenna 21. The elastic member 44 restricts the movement of the helical antenna 21 or absorbs impact when the helical antenna 21 is pushed in. Further, the elastic member 44 is used as a knob when the helical antenna 21 is lifted up.

Referring back to FIG. 2, as described above, the helical antenna 21 is so provided as to be movable with respect to the excitation antenna 20 in the axial direction A. More specifically, the cellular telephone is so constructed that the helical antenna 21 can move between an excitation position that is indicated by solid lines and an accommodation position that is indicated by two-dot chain line and can stand still at the excitation position and the accommodation position.

A cylindrical stopper 50 is provided in connection with the helical antenna 21. The stopper 50 is fixedly attached to a holder 51 that is fixed to the back body part 13 in a state that the antenna support pole 42 is inserted in the internal space of the stopper 50. The stopper 50 restricts the radial movement of the helical antenna 21 and causes the helical antenna 21 to stand still at the excitation position.

More specifically, the stopper 50 has, in its internal space, a drum spring 52 that is so provided as to pinch the antenna support pole 42. The drum spring 52 has such spring pressure as to restrict the radial movement of the antenna support pole 42 when the large diameter portion 42*a* or 42*b* of the antenna support pole 42 exists in the internal space and cancel the restriction on the movement of the antenna support pole 42 when the small diameter portion 42*c* exists in the internal space. The diameter of the internal space of the stopper 50 is set smaller than that of the tip member 43 of the antenna support pole 42.

To pull out the helical antenna 21 that is accommodated at the accommodation position, the user lifts up the helical antenna 21 holding the elastic member 44. As a result, the accommodation position determining large diameter portion 42*a* of the antenna support pole 42 is disengaged from the drum spring 52, then the small diameter portion 42*c* passes through the drum spring 52, and finally the excitation position determining large diameter portion 42*b* is pinched by the drum spring 52. Further, the tip member 43 of the antenna support pole 42 touches the bottom surface of the stopper 50, whereby the helical antenna 21 stands still at the excitation position as indicated by the solid lines in FIG. 2.

On the other hand, to accommodate the helical antenna 21 that is lifted up and exists at the excitation position, the user pushes in the helical antenna 21. As a result, the excitation position determining large diameter portion 42*b* of the antenna support pole 42 is disengaged from the drum spring 52, then the small diameter portion 42*c* passes through the drum spring 52, and finally the accommodation position determining large diameter portion 42*a* is pinched by the drum spring 52. At this time, the bottom surface of the elastic member 44 that is attached to the top end portion of the helical antenna 21 touches the top end surface of the antenna attachment portion 11. As a result, the helical antenna 21 stands still at the accommodation position as indicated by the two-dot chain lines in FIG. 2.

As described above, the diameter of the helical antenna 21 is set smaller than that of the excitation antenna 20.

Therefore, to move the helical antenna 21 along the central axis O, a guide member 53 is provided between the helical antenna 21 and the excitation antenna 20. The guide member 53 is of an annular shape and has a small diameter portion 53*a* and an inclined portion 53*b* whose diameter increases continuously from the end of the small diameter portion 53*a*. For example, the diameter of the small diameter portion 53*a* is set equal to the difference between the diameters of the helical antenna 21 and the excitation antenna 20.

The guide member 53 is mounted at the top end of the internal space of the excitation antenna 20 with its small diameter portion 53*a* located above. In other words, the guide member 53 is so provided that the diameter of the inclined portion 53*b* decreases in the lifting direction of the helical antenna 21. This structure assures a smooth movement of the helical antenna 21 along the central axis O when the user moves it. Further, since the contact area between the guide member 53 and the helical antenna 21 is smaller than that between the guide member 53 and inner circumferential surface of the excitation antenna 20, the Aguide member 53 is prevented from coming out of the internal space of the excitation antenna 20 when the helical antenna 21 is lifted up.

When the helical antenna 21 stands still at the excitation position, the helical antenna 21 and the excitation antenna 20 have the following positional relationship. Specifically, when the helical antenna 21 stands still at the excitation position, part of the antenna element surface 40 exists in the internal space of the excitation antenna 20. More specifically, when the helical antenna 21 stands still at the excitation position, the lower end portion of the antenna element surface 40 and the upper end portion of the excitation antenna 20 come close to each other in a non-contact state.

As a result, the helical antenna elements 41 and the dipole array antenna elements 32 that are formed in the top portion of the excitation antenna 20 come close to each other in a state that they do not contact each other electrically. In this state, the helical antenna elements 41 coextend with the dipole array antenna elements 32 over 5 mm, for example, when viewed from the side. Therefore, the helical antenna elements 41 and the dipole array antenna elements 32 are coupled with each other capacitively. By virtue of this structure, the helical antenna 21 exhibits a superior circular polarization characteristic when it stands still at the excitation position, that is, when it is pulled out. Therefore, the transmission/reception antenna 2 can transmit and receive radio waves with superior performance.

A signal transmitted from or received by the above-described transmission/reception antenna 2 is processed by circuits that are provided on the circuit board 60. More specifically, the circuit board 60 is like an approximately rectangular plate that measures 120 mm vertically and 45 mm horizontally and is 1.2 mm in thickness, for example. The circuit board 60 is mounted with various circuits such as a transmission/reception circuit 60*a* for radio communication, an input/output control circuit for controlling man-machine interfaces such as the display section 4 and the key manipulation section 5, and a signal processing circuit for processing signals that are input to or output from the transmission/reception circuit 60*a* and the input/output control circuit.

The transmission/reception circuit 60*a* is electrically connected via a plurality of (e.g., 11 or 17) conductive leaf springs 61 (connection members) to the feeding circuit 33 that is formed on the feeding surface 31 of the excitation antenna 20. The leaf springs 61 are attached to the circuit board 60. As described above, in this cellular telephone, all the electronic parts necessary for the cellular telephone other than the antenna elements 32 and 4 are incorporated in the body main part 1. That is, the antenna elements 32 and 41 can transmit and receive radio waves without being influenced by the other electronic parts.

Reference numeral 62 denotes a shield case that is so disposed as to cover peripheral portions of the circuit board 60 and serve to shield (protect) the circuits on the circuit board 60 from high-frequency waves.

Incidentally, to construct this cellular telephone, it is necessary to connect the circuit board 60 and the transmission/reception antenna 2 at correct positions. To this end, it is necessary to make the relative positional relationship between the circuit board 60 and the transmission/reception antenna 2 as accurate as possible e. on the other hand, in the cellular telephone of the first embodiment, since the excitation antenna 20 is integrally molded with the back body part 13, the excitation antenna 20 is high in positional accuracy.

As a result, the relative positional relationship between the circuit board 60 and the transmission/reception antenna 2 is also o highly accurate. For this reason, the c contacts of the transmission/reception circuit 60*a* that are formed on the circuit board 60 and those of the feeding circuit 33 can easily be connected to each other via the leaf springs 61, respectively. Therefore, the transmission/reception circuit 60*a* and the feeding circuit 33 can be connected to each other at correct positions.

As described above, according to the first embodiment, the fixed excitation antenna 20 is integrally molded with and attached to the body 1. Therefore, the number of manufacturing steps of this cellular telephone can be made smaller than in the case where the excitation antenna 20 is attached to the body 1 via an accompanied attaching member. Therefore, the first embodiment can simplify the manufacturing work, and hence can shorten the manufacturing time, which means increased manufacturing efficiency.

Since the excitation antenna 20 is integrally molded with and attached to the body 1, the attachment strength of the excitation antenna 20 can be made higher than a certain level in contrast to the case where the excitation antenna 20 is attached to the body 1 via an accompanied attaching member. This makes it possible to provide highly reliable cellular telephones.

In the first embodiment, the excitation antenna 20 is attached to the antenna attachment portion 11 so as to be in close contact with the latter. Therefore, there is no air layer between the antenna element surface 30 of the excitation antenna 20 and the inner circumferential surface 25 of the antenna attachment portion 11. Further, since the excitation antenna 20 and the antenna attachment portion 11 are integrally molded with each other, the width between the antenna element surface 30 and the outer circumferential surface of the excitation antenna 20 can be made approximately uniform. In addition, all the electronic parts etc. that are necessary for the cellular telephone other than the antenna elements 32 and 41 are incorporated in the body main part 10. Therefore, the transmission/reception antenna 2 can be given stable antenna characteristics, resulting in high-quality transmission and reception performance.

Since the excitation antenna 20 is attached to the antenna attachment portion 11 so as to be in close contact with the latter, the dipole array antenna elements 32 that are formed by plating can be protected. That is, the dipole array antenna elements 32 can be prevented from being damaged.

Since the excitation antenna 20 is integrally molded with and attached to the body 1, no attaching member is necessary that is dedicated to the attachment of the excitation antenna 20 and hence, no space is required for such an attachment member. Therefore, the first embodiment makes it possible to cope with a limitation on the width or thickness of the cellular telephone, if any. That is, the first embodiment makes it to possible to provide miniaturized cellular telephones.

Further, since the excitation antenna 20 is integrally molded with the body 1, the relative positional error between the excitation antenna 20 and the circuit board 60 can be made within a prescribed tolerance. Therefore, the feeding circuit 33 of the excitation antenna 20 and the radio transmission/reception circuit 60*a* on the circuit board 60 can be connected to each other at correct positions.

Embodiment 2

Figure 5:
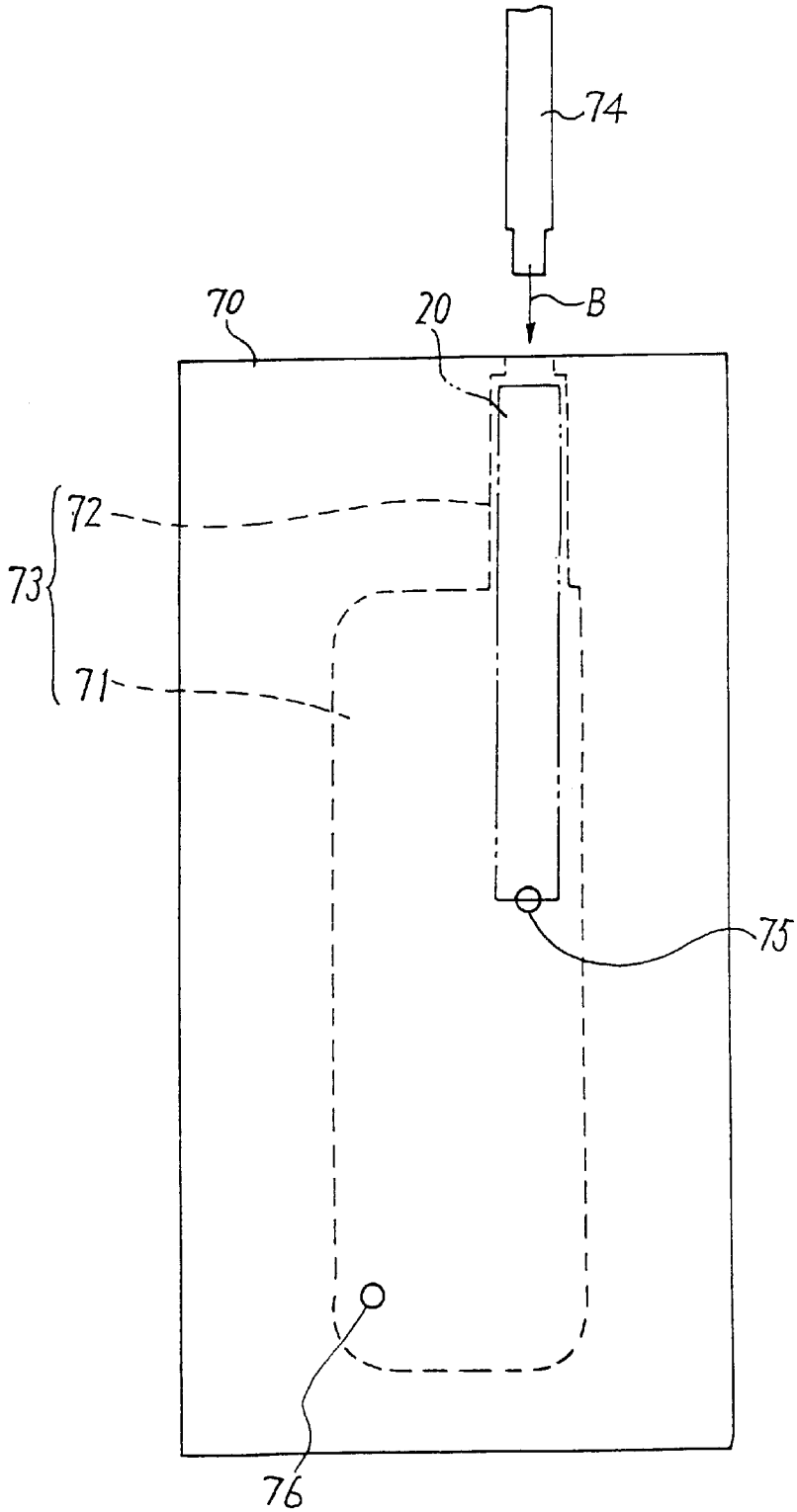
FIG. 5 illustrates a manufacturing method of a back body part as part of a body according to a second embodiment of the invention.

FIG. 5 illustrates a manufacturing method of the back body part 13 as part of the body 1 according to a second embodiment of the invention. As described above, the back body part 13 has part of the body main part 10 and the antenna attachment portion 11, and the transmission/reception antenna 2 including the excitation antenna 2 and the helical antenna 21 is attached to the back body part 13.

Figure 6:
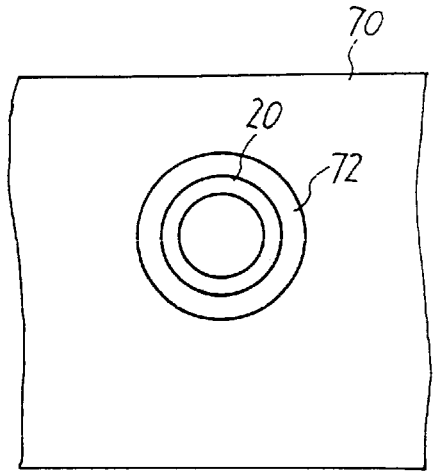
FIG. 6 is a top view showing the structure of a die in a state that an excitation antenna is inserted therein.
Figure 7:
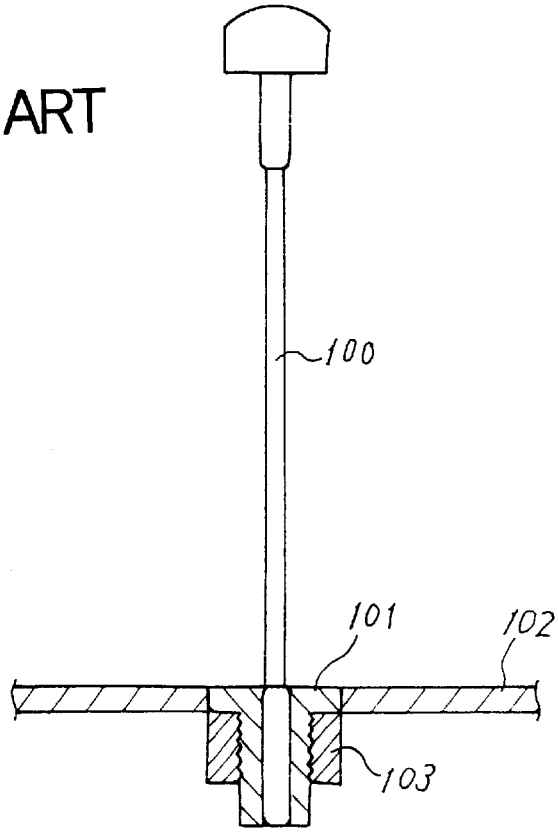
FIG. 7 PRIOR ART
FIG. 7 shows a structure for attaching, to a body, an antenna that is provided in a related art cellular telephone.

The back body part 13 is manufactured by injection molding by using a dedicated die 70. More specifically, as indicated by a broken line in FIG. 5, the die 70 is equipped with a cavity 73 having a main part cavity 71 and an antenna cavity 72. The main part cavity 71 is so shaped as to correspond to the back body part 13 of the body main part 10. The antenna cavity 72 corresponds to the antenna attachment portion 11 and has a circular sectional shape. The antenna cavity 72 reaches an end of the die 70. Therefore, as shown in FIG. 6, the die 70 looks like having a hole when viewed from above.

With the die 70 having the above structure, an excitation antenna 20 that has been formed with an antenna element surface 30 is inserted into the antenna cavity 72 as indicated by a two-dot chain line and then accommodated in the cavity 73. Specifically, the excitation antenna 20 is accommodated at such a position that the antenna element surface 30 of the excitation antenna 20 is faced at the inner circumferential surface of the antenna cavity 72.

An attempt is made to correctly position the excitation antenna 20 that is accommodated in the cavity 73. Specifically, 3a reference pin 74 is inserted in the direction indicated by arrow B into the internal space of the excitation antenna 20 that is accommodated in the cavity 73. The reference pin 74 is correctly positioned with respect to the die 70. Therefore, by inserting the reference pin 74, the excitation antenna 20 is correctly positioned with respect to the die 70. Further, a fixing pin (not shown) is inserted through a pin insertion hole 75 and engaged with the pin engagement recess 34 (see FIG. 2). As a result, the excitation antenna 20 is prevented from deviating in the axial direction, radial direction, or circumferential direction during molding.

After the excitation antenna 20 has been positioned correctly with respect to the die 70, an ABS resin is injected into the cavity 73 through an injection hole 76 and spreads to fill in the cavity 73. At this time, the ABS resin spreads so as to surround the excitation antenna 20. As a result, a body main part 10 (including a back body part 13) and an antenna attachment portion 11 are formed and, at the same time, the excitation antenna 20 is integrally molded with the back body part 13 thus formed. In this manner, the back body part 13 is produced to which the excitation antenna 20 is attached integrally.

Then, the back body part 13 thus produced is removed from the die 70. Thereafter, an helical antenna 21 in which an antenna element surface 40 has been formed and to which an elastic member 44 and an antenna support pole 42 mounted with a stopper 50 have been attached is accommodated in the internal space of the excitation antenna 20. Then, the stopper 50 is fixedly attached to a holder 51. As a result, the helical antenna 21 is attached to the back body part 13. In this manner, the helical antenna 21 can be attached to the back body part 13 such that when lifted up from the internal space of the excitation antenna 20, the helical antenna 21 erects at the excitation position where the dipole array antenna elements 32 and the helical antenna elements 41 are coupled with each other capacitively.

A cellular telephone can be manufactured by connecting the back body part 13 thus produced to a front body part 12 that has been mounted with a circuit board 60 and electrically connecting the dipole array antenna elements 32 and the transmission/reception circuit 60*a* on the circuit board 60.

As described above, according to the second embodiment, the back body part 13 in which the excitation antenna 20 is attached to the inner circumferential surface 25 of the antenna attachment portion 11 can be produced by making an ABS resin flow into the die 70 in a state that the excitation antenna 20 is mounted on the die 70. Therefore, the number of steps for producing the back body part 13 can be made smaller than in a process in which a back body part 13 is molded by using a die, then an attaching member for an excitation antenna and other parts are attached to the back body part 13, and finally the excitation antenna is attached to the back body part 13 via the attaching member. Therefore, the manufacturing time can be shortened, which means increased manufacturing efficiency.

In addition, since the excitation antenna 20 and the back body part 13 are produced at the same time, it is not necessary to manage the number of excitation antennas 20 and the number of back body parts 13 separately. This decreases the burden on operators.

Other Embodiments

Although the invention has been described above by using the two embodiments, the invention is not limited to those embodiments. For example, the above embodiments are directed to the case where the invention is applied to a dual mode terminal that is applied to satellite cellular telephone systems and terrestrial cellular telephone systems. However, for example, the invention can easily be applied to a single mode terminal that is applied to only satellite cellular telephone systems.

Further, although the above embodiments are directed to the case where the invention is applied to a cellular telephone, the invention can easily be applied to portable radio devices other than cellular telephones.

What is claimed is:

1. A portable radio device comprising:

a body incorporating a transmission/reception circuit for radio communication and having a cylindrical antenna attachment portion that projects outward; and an antenna device having a first antenna that is attached to the antenna attachment portion and a second antenna that is provided movably and is to be electrically coupled with the first antenna;

wherein the first antenna has first antenna elements that are formed on an outer circumferential surface and electrically connected to the transmission/reception circuit, and is integrally molded with the antenna attachment portion such that the first antenna elements come into close contact with an inner circumferential surface of the antenna attachment portion.

2. The portable radio device according to claim 1, wherein the first antenna is an excitation antenna and has a feeding circuit and dipole array antenna elements that are formed on the circumferential surface.

3. The portable radio device according to claim 2, wherein the dipole array antenna elements are inclined from a central axis of the excitation antenna and formed at equal intervals.

4. The portable radio device according to claim 1, wherein the second antenna is a helical antenna having helical antenna elements formed on a circumferential surface, which is accommodated in an internal space of the first antenna, and wherein the helical antenna elements are electrically coupled with the first antenna elements in a state in which the helical antenna is pulled out of the first antenna.

5. The portable radio device according to claim 4, wherein the helical antenna elements are inclined from a central axis of the helical antenna and formed at equal intervals.

6. The portable radio device according to claim 1, wherein the first antenna is integrally molded with the antenna attachment portion such that no air layer is interposed between the first antenna and the antenna attachment portion.

7. The portable radio device according to claim 1, wherein the body includes a front body part and a back body part that is connected to the front body part and has the antenna attachment portion, wherein the transmission/reception circuit is attached to the front body part, and wherein the first antenna is attached to the antenna attachment portion of the back body part.

8. The portable radio device according to claim 1, wherein the first antenna and the second antenna are arranged so as to be concentric with each other with respect to a common central axis.

9. The portable radio device according to claim 1, wherein the first antenna and the body are made of an acrylonitrile-butadiene-styrene resin.

10. The portable radio device according to claim 1, wherein the antenna device is one that is used in a satellite cellular telephone.

11. The portable radio device according to claim 10, further comprising a terrestrial cellular telephone antenna that is incorporated in the body and electrically connected to the transmission/reception circuit.

12. A manufacturing method of a portable radio device body that has a cylindrical antenna attachment portion projecting outward from a body main part and which a cylindrical antenna having antenna elements formed on an outer circumferential surface thereof is attached to an inner circumferential surface of the antenna attachment portion, comprising the steps of:

positioning the antenna in a die that is formed with a main part cavity having a shape corresponding to the antenna attachment portion such that the antenna elements formed on the outer circumferential surface of the antenna are facing an inner circumferential surface of the antenna cavity; and forming the body main part and the antenna attachment portion and simultaneously integrally molding them with each other such that the antenna elements of the antenna come into close contact with the inner circumferential surface of the antenna attachment portion by injecting a resin into the main part cavity and the antenna cavity.

13. The manufacturing method according to claim 12, wherein the step of positioning the antenna in the die includes the steps of inserting a reference piniro aft internal space of the antenna, and engaging a fixing pin with a pin engagement recess that is formed in the antenna.

* * * * *

UNITED STATES PATENT AND TRADEMARK OFFICE

CERTIFICATE OF CORRECTION

PATENT NO. : 6,445,347 B1
DATED : September 3, 2002
INVENTOR(S) : Akitoshi Yoshimi It is certified that error appears in the above-identified patent and that said Letters Patent is hereby corrected as shown below:

Column 4,
Line 56, "length 11" should be -- length ℓ1 --.

Column 5,
Line 2, "Am" should be -- $\mu$m --.

Column 7,
Line 20, "Aguide" should be -- guide --.

Column 8,
Line 4, "4" should be -- 41 --;
Line 5, "part 1" should be -- part 10 --;
Line 16, delete the letter "e";
Line 16, "on" should be -- On --;
Line 23, delete the letters "o" and "c".

Column 9,
Line 46, "3a" should be -- a --.

Column 12,
Line 13, after "and" insert -- in --;
Line 33, "piniro aft" should be -- pin into an --;

Signed and Sealed this

Thirteenth Day of May, 2003

JAMES E. ROGAN
*Director of the United States Patent and Trademark Office*